US010490153B2

(12) United States Patent
Kim et al.

(10) Patent No.: US 10,490,153 B2
(45) Date of Patent: Nov. 26, 2019

(54) DATA DRIVER AND A DISPLAY APPARATUS INCLUDING THE SAME

(71) Applicant: SAMSUNG DISPLAY CO., LTD., Yongin-si, Gyeonggi-Do (KR)

(72) Inventors: Wontae Kim, Hwaseong-si (KR); Guhui Jo, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/456,720

(22) Filed: Mar. 13, 2017

(65) Prior Publication Data

US 2017/0309244 A1 Oct. 26, 2017

(30) Foreign Application Priority Data

Apr. 22, 2016 (KR) ..... 10-2016-0049383

(51) Int. Cl.
*G09G 3/36* (2006.01)

(52) U.S. Cl.
CPC ... *G09G 3/3688* (2013.01); *G09G 2310/0251* (2013.01); *G09G 2310/0291* (2013.01); *G09G 2310/06* (2013.01); *G09G 2310/08* (2013.01); *G09G 2320/0223* (2013.01)

(58) Field of Classification Search
CPC ..... G09G 3/3688; G09G 2310/0251; G09G 2310/0291; G09G 2310/06; G09G 2310/08; G09G 2320/0223
USPC ..... 345/100
See application file for complete search history.

(56) References Cited

U.S. PATENT DOCUMENTS

2002/0047840 A1* 4/2002 Fukuda ..... G09G 3/3688 345/212
2009/0219276 A1* 9/2009 Hirama ..... G09G 3/3688 345/213
2011/0018853 A1* 1/2011 Kawagoshi ..... G09G 3/3688 345/211
2011/0080214 A1* 4/2011 Tsuchi ..... G09G 3/3688 330/69
2015/0035813 A1* 2/2015 Lei ..... G09G 3/3208 345/205
2015/0213779 A1* 7/2015 Baek ..... G09G 5/008 345/204

FOREIGN PATENT DOCUMENTS

KR 1020150089914 8/2015
KR 10-2016-0110619 9/2016

* cited by examiner

*Primary Examiner* — Stephen G Sherman
(74) *Attorney, Agent, or Firm* — F. Chau & Associates, LLC

(57) ABSTRACT

A data driver includes an N-th amplifier including first and second input nodes and a first output node and configured to output an N-th data voltage to an N-th data line, the first input node receiving the N-th data voltage from an N-th node, the second input node being connected to the first output node, a first switch connected between the N-th node and the first input node, and a second switch connected between the first input node and the second input node.

19 Claims, 9 Drawing Sheets

501

DATA DRIVER AND A DISPLAY APPARATUS INCLUDING THE SAME

CROSS-REFERENCE TO RELATED APPLICATION

This application claims priority under 35 U.S.C. § 119 to Korean Patent Application No. 10-2016-0049383, filed on Apr. 22, 2016 in the Korean Intellectual Property Office (KIPO), the disclosure of which is incorporated by reference herein in its entirety.

TECHNICAL FIELD

Exemplary embodiments of the present inventive concept relate generally to display devices, and more particularly, to data drivers and display apparatuses including the data drivers.

DESCRIPTION OF THE RELATED ART

Generally, a liquid crystal display ("LCD") apparatus includes a first substrate including a pixel electrode, a second substrate including a common electrode and a liquid crystal layer disposed between the first and second substrates. An electric field is generated by voltages applied to the pixel electrode and the common electrode. By adjusting an intensity of the electric field, a transmittance of light passing through the liquid crystal layer may be adjusted so that an image may be displayed.

The LCD apparatus also includes a display panel and a panel driver. The display panel includes a plurality of gate lines, a plurality of data lines and a plurality of pixels connected to the gate lines and the data lines. The panel driver includes a gate driver for providing gate signals to the gate lines and a data driver for providing data voltages to the data lines.

The gate driver includes a plurality of switching elements. The switching elements are controlled by clock signals, and generate the gate signals. According to the position of each switching element in the display panel, the gate signals are delayed due to a resistive-capacitive (RC) delay. Thus, the charging rate of each pixel depends on its position in the display panel. In other words, the charging rates of the pixels may vary in the display panel.

SUMMARY

A data driver according to an exemplary embodiment of the present inventive concept includes an N-th amplifier comprising first and second input nodes and a first output node and configured to output an N-th data voltage to an N-th data line, the first input node receiving the N-th data voltage from an N-th node, the second input node being connected to the first output node, a first switch connected between the N-th node and the first input node, and a second switch connected between the first input node and the second input node.

In an exemplary embodiment of the present inventive concept, the data driver further comprises an (N−1)-th amplifier configured to output an (N−1)-th data voltage to an (N−1)-th data line, wherein the (N−1)-th amplifier is configured to start outputting the (N−1)-th data voltage at a first time during a first horizontal duration, and the N-th amplifier is configured to start outputting the N-th data voltage at a second time during the first horizontal duration, the second time being later than the first time, and wherein the first switch is open at the first time, and the second switch is closed at the first time.

In an exemplary embodiment of the present inventive concept, the first switch is closed at the second time, and the second switch is open at the second time.

In an exemplary embodiment of the present inventive concept, the (N−1)-th amplifier is configured to stop outputting the (N−1)-th data voltage at a third time, and the N-th amplifier is configured to stop outputting the N-th data voltage at a fourth time later than the third time, and wherein the first switch is open at the third time, and the second switch is closed at the third time.

In an exemplary embodiment of the present inventive concept, the first switch is closed at the fourth time, and the second switch is open at the fourth time.

In an exemplary embodiment of the present inventive concept, the data driver further comprises an (N+1)-th amplifier comprising third and fourth input nodes and a second output node and configured to start outputting an (N+1)-th data voltage to an (N+1)-th data line at a third time during the first horizontal duration, the third input node receiving the (N+1)-th data voltage from an (N+1)-th node, the fourth input node being connected to the second output node, the third time being later than the second time, a third switch connected between the (N+1)-th node and the third input node and open at the first and second times, and a fourth switch connected between the third input node and the fourth input node and closed at the first and second times.

In an exemplary embodiment of the present inventive concept, the third switch is closed at the third time, and the fourth switch is open at the third time.

In an exemplary embodiment of the present inventive concept, the first and second switches are configured to be controlled by an N-th enable signal and are configured to operate in an opposite way from each other in response to the N-th enable signal.

A display apparatus according to an exemplary embodiment of the present inventive concept includes a display panel comprising a plurality of gate lines and an N-th data line and configured to display an image, a gate driver configured to output gate signals to the gate lines, and a data driver comprising an N-th amplifier comprising first and second input nodes and a first output node and configured to output an N-th data voltage to the N-th data line, the first input node receiving the N-th data voltage from an N-th node, the second input node being connected to the first output node, a first switch connected between the N-th node and the first input node, and a second switch connected between the first input node and the second input node.

In an exemplary embodiment of the present inventive concept, the display panel further comprises an (N−1)-th data line, wherein the data driver further comprises an (N−1)-th amplifier configured to output an (N−1)-th data voltage to the (N−1)-th data line, wherein the (N−1)-th amplifier is configured to start outputting the (N−1)-th data voltage at a first time during a first horizontal duration, and the N-th amplifier is configured to start outputting the N-th data voltage at a second time during the first horizontal duration, the second time being later than the first time, and wherein the first switch is open at the first time, and the second switch is closed at the first time.

In an exemplary embodiment of the present inventive concept, the N-th data line is spaced farther apart from the gate driver than the (N−1)-th data line.

In an exemplary embodiment of the present inventive concept, the first switch is closed at the second time, and the second switch is open at the second time.

In an exemplary embodiment of the present inventive concept, the (N−1)-th amplifier is configured to stop outputting the (N−1)-th data voltage at a third time, and the N-th amplifier is configured to stop outputting the N-th data voltage at a fourth time later than the third time, and wherein the first switch is open at the third time, and the second switch is closed at the third time.

In an exemplary embodiment of the present inventive concept, the first switch is closed at the fourth time, and the second switch is open at the fourth time.

In an exemplary embodiment of the present inventive concept, the display panel further comprises an (N+1)-th data line, and wherein the data driver further comprises an (N+1)-th amplifier comprising third and fourth input nodes and a second output node and configured to start outputting an (N+1)-th data voltage to the (N+1)-th data line at a third time during the first horizontal duration, the third input node receiving the (N+1)-th data voltage from an (N+1)-th node, the fourth input node being connected to the second output node, the third time being later than the second time, a third switch connected between the (N+1)-th node and the third input node and open at the first and second times, and a fourth switch connected between the third input node and the fourth input node and closed at the first and second times.

In an exemplary embodiment of the present inventive concept, the (N+1)-th data line is spaced farther apart from the gate driver than the (N−1)-th and N-th data lines.

In an exemplary embodiment of the present inventive concept, the third switch is closed at the third time, and the fourth switch is open at the third time.

In an exemplary embodiment of the present inventive concept, the data driver is configured to generate an N-th enable signal based on the first and second times, and wherein the first and second switches are configured to be controlled by the N-th enable signal and are configured to operate in an opposite way from each other in response to the N-th enable signal.

In an exemplary embodiment of the present inventive concept, the first switch is closed when the N-th enable signal has a high level and is open when the N-th enable signal has a low level, and wherein the N-th enable signal has the low level at the first time and has the high level at the second time.

A data driver according to an exemplary embodiment of the present inventive concept includes an amplifier including an inverting input node, a non-inverting input node and an output node; a first switch connected between the non-inverting input node and first input node through which a data voltage is provided; and a second switch connected between the inverting input node and the non-inverting input node, the second switch further connected to the output node, wherein the first and second switches are operated in response to an enable signal.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF EMBODIMENTS

Hereinafter, the exemplary embodiments of present inventive concept will be explained in detail with reference to the accompanying drawings.

Figure 1:
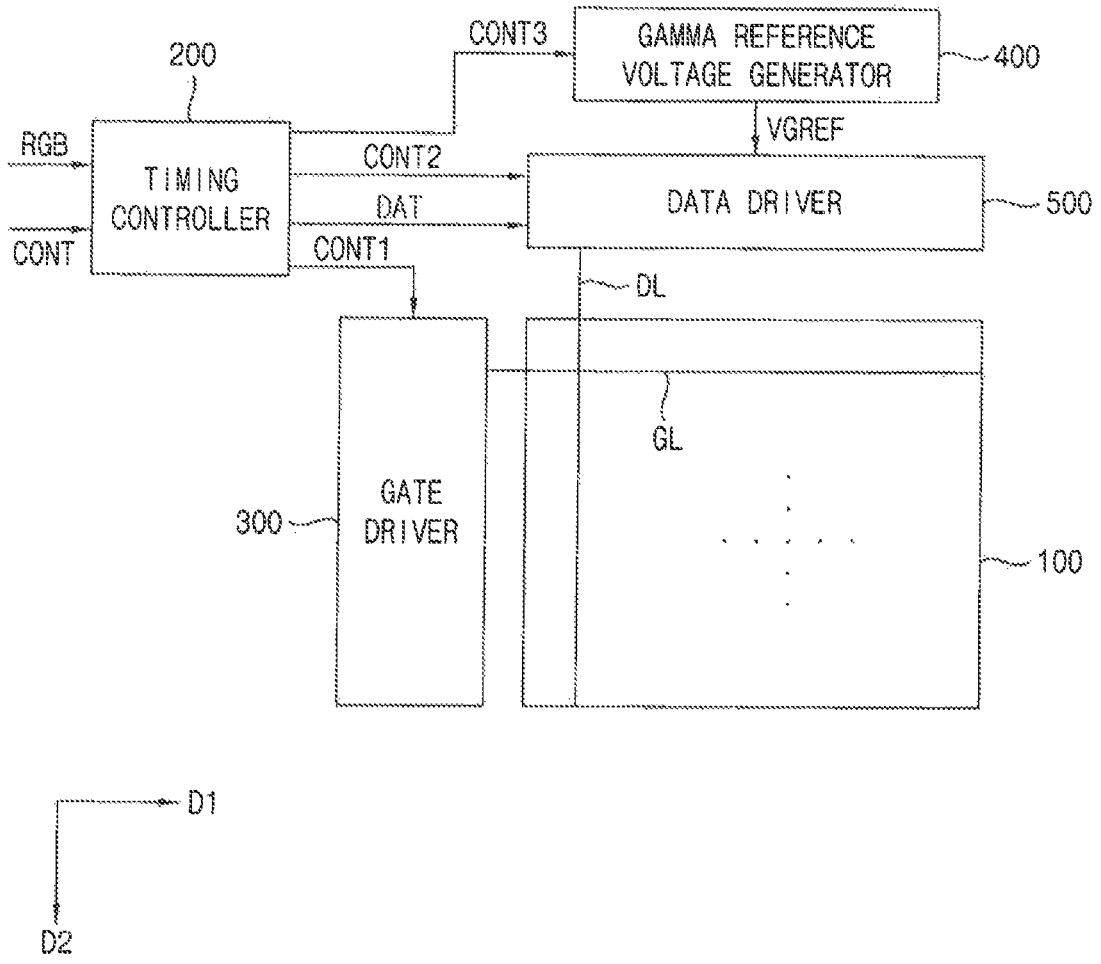
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In an exemplary embodiment of the inventive concept, the pixels may include a switching element, a liquid crystal capacitor and a storage capacitor. The liquid crystal capacitor and the storage capacitor may be electrically connected to the switching element. The pixels may be arranged in a matrix configuration.

The display panel 100 will be explained in detail with reference to FIG. 2.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DAT based on (or in response to) the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500. The data signal DAT may be substantially the same image data as the input image data RGB or the data signal DAT may be compensated image data generated by compensating the input image data RGB. For example, the timing controller 200 may perform an image quality compensation, a spot compensation, an adaptive color correction (ACC), or a dynamic capacitance compensation (DCC) on the input image data RGB to generate the data signal DAT.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

The gate signals may become delayed as a distance from the gate driver 300 increases because of a resistive-capacitive (RC) delay of the gate lines GL. For example, a gate signal provided to a switching element disposed adjacent to the right side of the display panel 100 may be more delayed than a switching element disposed adjacent to the left side of the display panel 100.

In an exemplary embodiment of the present inventive concept, the gate driver 300 may be directly mounted on the display panel 100, or may be connected to the display panel 100 as a tape carrier package (TCP) type. Additionally, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment of the present inventive concept, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 outputs the data voltages to the data lines DL.

The data driver 500 may output the data voltages to the data lines DL at different times. For example, the data driver 500 may control start times for outputting the data voltages according to a distance from the gate driver 300 during each horizontal duration.

In an exemplary embodiment of the present inventive concept, the data driver 500 may be directly mounted on the display panel 100, or may be connected to the display panel 100 as a TCP type. Additionally, the data driver 500 may be integrated on the peripheral region 120 of the display panel 100.

The data driver 500 will be explained in detail with reference to FIGS. 2 and 3A through 3C.

Figure 2:
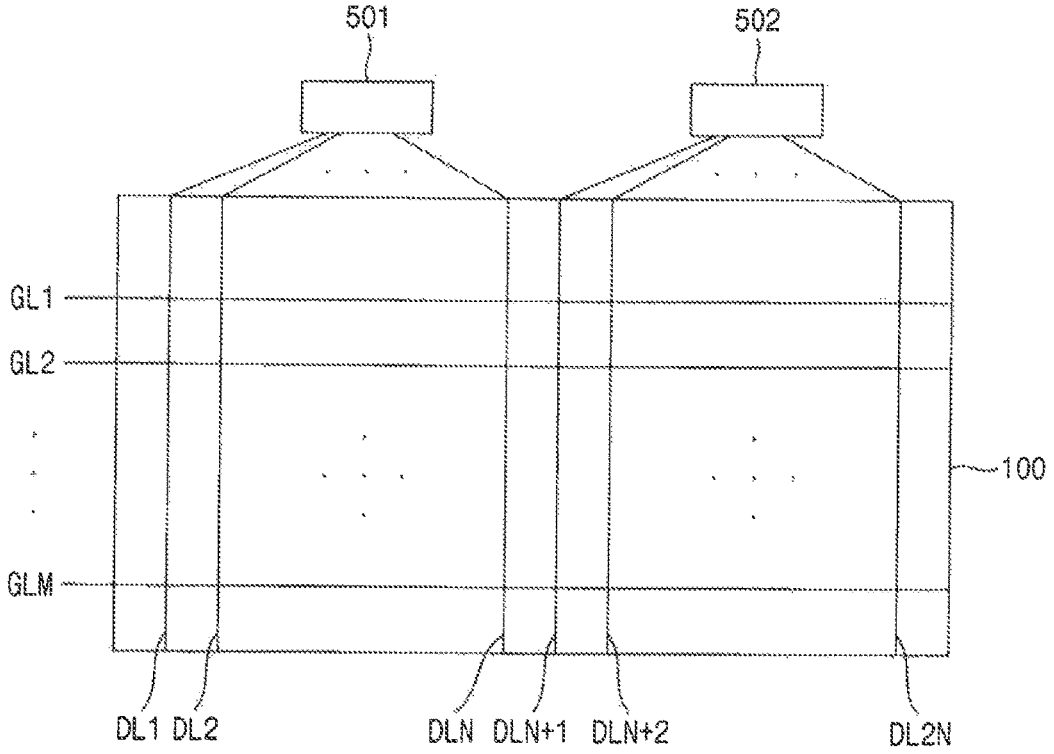
FIG. 2 is a block diagram illustrating a display panel and a data driver included in a display apparatus according to an exemplary embodiment of the present inventive concept.

FIG. 2 is a block diagram illustrating a display panel and a data driver included in a display apparatus according to an exemplary embodiment of the present inventive concept.

Referring to FIGS. 1 and 2, the data driver 500 may include a plurality of data driving chips. For example, the data driver 500 may include a first data driving chip 501 and a second data driving chip 502. The data driver 500 may include more than two data driving chips.

The display panel 100 may include a plurality of gate lines and a plurality of data lines. For example, the display panel 100 may include first through M-th gate lines GL1~GLM. The first through M-th gate lines GL1~GLM may extend in the first direction D1. The display panel 100 may include first through N-th and (N+1)-th through 2N-th data lines DL1~DLN, DLN+1~DL2N. The first through 2N-th data lines may extend in the second direction D2.

The first data driving chip 501 may be connected to the first through N-th data lines DL1~DLN and may output data voltages to the first through N-th data lines DL1~DLN.

The second data driving chip 502 may be connected to the (N+1)-th through 2N-th data lines DLN+1~DL2N and may output data voltages to the (N+1)-th through 2N-th data lines DLN+1~DL2N.

Figure 3A:
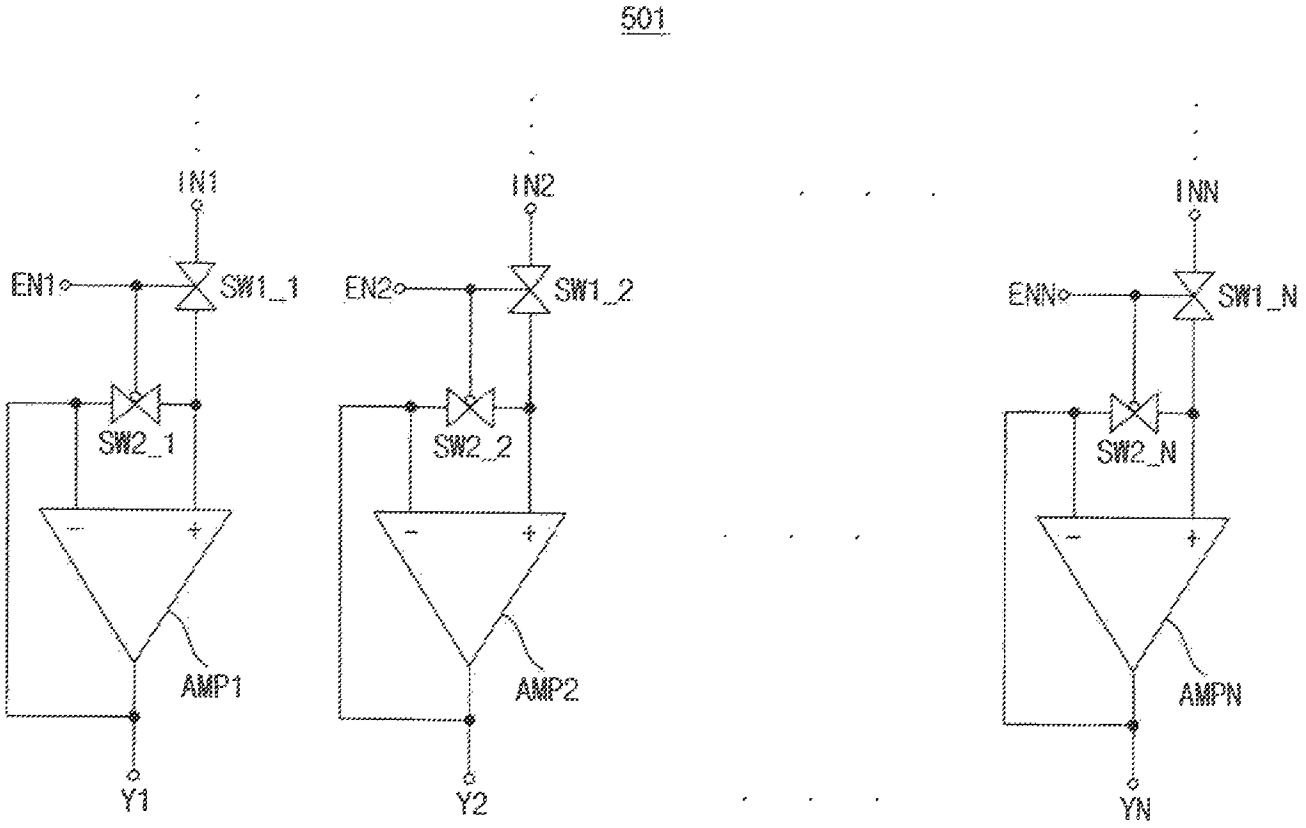
FIG. 3A is a circuit diagram illustrating a part of a data driver according to an exemplary embodiment of the present inventive concept.

FIG. 3A is a circuit diagram illustrating a part of a data driver according to an exemplary embodiment of the present inventive concept.

Referring to FIGS. 1, 2 and 3A, the first data driving chip 501 includes first through N-th amplifiers AMP1~AMPN corresponding to the first through N-th data lines DL1~DLN respectively. For example, the first amplifier AMP1 is connected to the first data line DL1 through a first output node Y1. The second amplifier AMP2 is connected to the second data line DL2 through a second output node Y2. The N-th amplifier AMPN is connected to the N-th data line DLN through an N-th output node YN.

The first data driver 501 includes first switches SW1_1~SW1_N and second switches SW2_1~SW2_N corresponding to the first through N-th amplifiers AMP1~AMPN respectively. For example, the first data driving chip 501 includes a first switch SW1_1 and a second switch SW2_1 corresponding to the first amplifier AMP1. The first data driving chip 501 includes a first switch SW1_2 and a second switch SW2_2 corresponding to the second amplifier AMP2. The first data driving chip 501 includes a first switch SW1_N and a second switch SW2_N corresponding to the N-th amplifier AMPN.

The first amplifier AMP1 includes an inverting input node (−), a non-inverting input node (+) and the first output node Y1. The inverting node is connected to the first output node Y1. The first amplifier AMP1 receives a first data voltage from a first input node IN1 through the non-inverting input node. The first amplifier AMP1 outputs the first data voltage to the first data line DL1 through the first output node Y1. The first switch SW1_1 is connected between the first input node IN1 and the non-inverting input node. The second switch SW2_1 is connected between the inverting input node and the non-inverting input node. The first switch SW1_1 and the second switch SW2_1 may be controlled by a first enable signal EN1. The first switch SW1_1 and the second switch SW2_1 may operate in an opposite way from each other based on (or in response to) the first enable signal EN1. For example, the first switch SW1_1 may be closed when the first enable signal EN1 has a high level and may be open when the first enable signal EN1 has a low level. The second switch SW2_1 may be open when the first enable signal EN1 has the high level and may be closed when the first enable signal EN1 has the low level. A role of each of the inverting and non-inverting input nodes may be exchanged.

The second amplifier AMP2 includes an inverting input node (−), a non-inverting input node (+) and the second output node Y2. The inverting node is connected to the second output node Y2. The second amplifier AMP2 receives a second data voltage from a second input node IN2 through the non-inverting input node. The second amplifier AMP2 outputs the second data voltage to the second data line DL2 through the second output node Y2. The first switch SW1_2 is connected between the second input node IN2 and the non-inverting input node. The second switch SW2_2 is connected between the inverting input node and the non-inverting input node. The first switch SW1_2 and the second switch SW2_2 may be controlled by a second enable signal EN2. The first switch SW1_2 and the second switch SW2_2 may operate in an opposite way from each other based on the second enable signal EN2. For example, the first switch SW1_2 may be closed when the second enable signal EN2 has a high level and may be open when the second enable signal EN2 has a low level. The second switch SW2_2 may be open when the second enable signal EN2 has the high level and may be closed when the second enable signal EN2 has the low level. A role of each of the inverting and non-inverting input nodes may be exchanged.

The N-th amplifier AMPN includes an inverting input node (−), a non-inverting input node (+) and the N-th output node YN. The inverting node is connected to the N-th output node YN. The N-th amplifier AMPN receives an N-th data voltage from an N-th input node INN through the non-inverting input node. The N-th amplifier AMPN outputs the N-th data voltage to the N-th data line DLN through the N-th output node YN. The first switch SW1_N is connected between the N-th input node INN and the non-inverting input node. The second switch SW2_N is connected between the inverting input node and the non-inverting input node. The first switch SW1_N and the second switch SW2_N may be controlled by an N-th enable signal ENN. The first switch SW1_N and the second switch SW2_N may operate in an opposite way from each other based on the N-th enable signal ENN. For example, the first switch SW1_N may be closed when the N-th enable signal ENN has a high level and may be open when the N-th enable signal ENN has a low level. The second switch SW2_N may be open when the N-th enable signal ENN has the high level and may be closed when the N-th enable signal ENN has the low level. A role of each of the inverting and non-inverting input nodes may be exchanged.

The first data driving chip 501 may further include a shift register, a latch, a decoder and a level shifter. The decoder may provide the first through N-th data voltages to the first through N-th input nodes IN1~INN respectively.

Figure 3B:
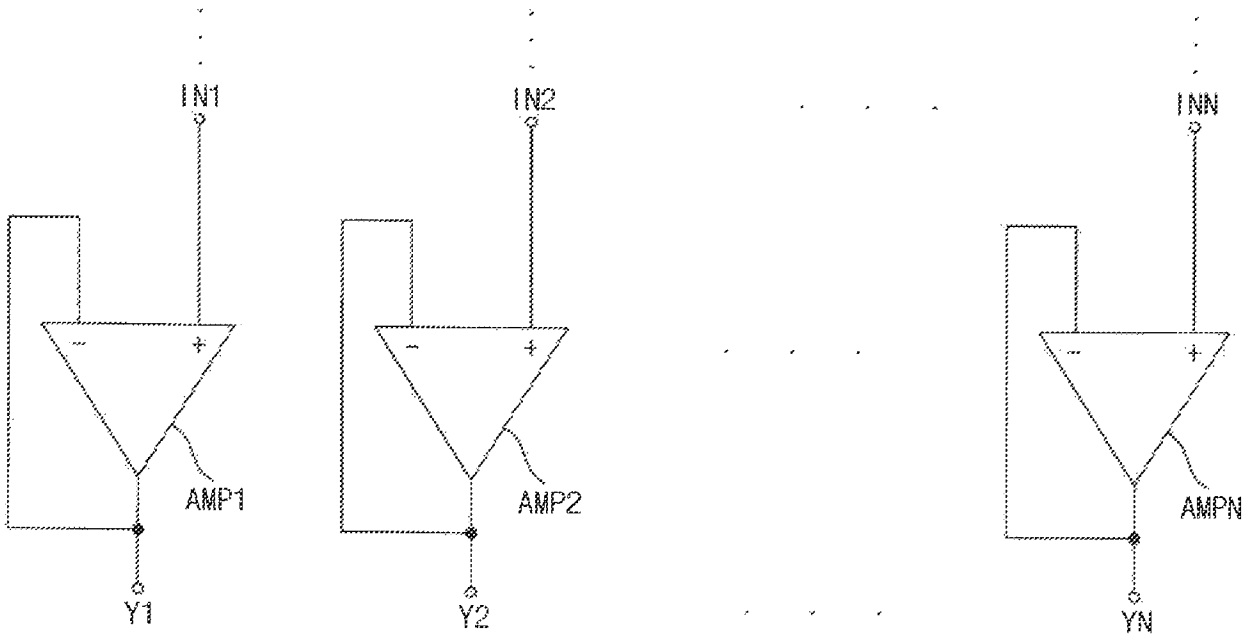
FIGS. 3B and 3C are circuit diagrams illustrating an equivalent circuit of a part of a data driver according to an exemplary embodiment of the present inventive concept.
Figure 3C:
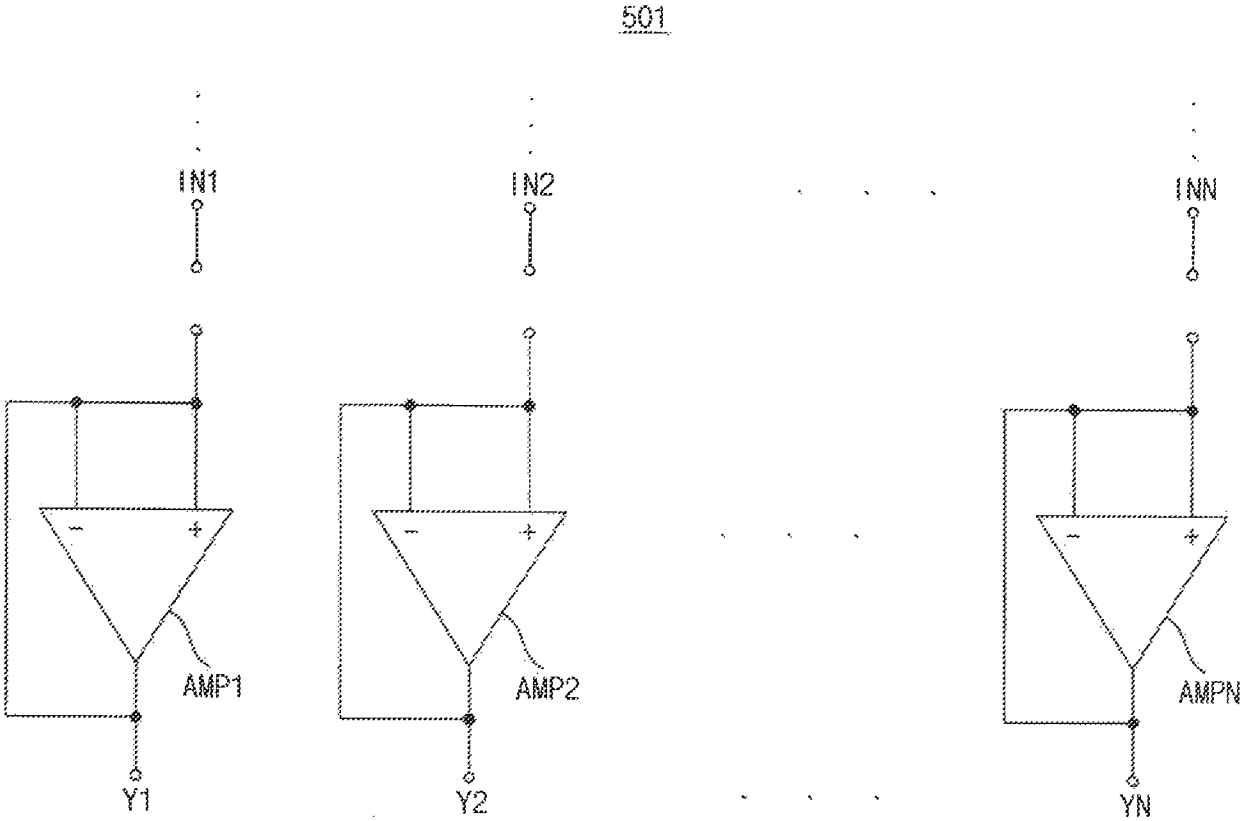

FIGS. 3B and 3C are circuit diagrams illustrating an equivalent circuit of a part of a data driver according to exemplary embodiments of the present inventive concept.

FIG. 3B illustrates when the first switches SW1_1~SW1_N of FIG. 3A are closed and the second switches SW2_1~SW2_N of FIG. 3A are open. FIG. 3C illustrates when the first switches SW1_1~SW1_N of FIG. 3A are open and the second switches SW2_1~SW2_N of FIG. 3A are closed.

Referring to FIG. 3B, first through N-th amplifiers AMP1~AMPN operate as a normal amplifier. The first through N-th amplifiers AMP1~AMPN receive data voltages from first through N-th input nodes IN1~INN and output the data voltages to first through N-th output nodes Y1~YN.

Referring to FIG. 3C, first through N-th amplifiers AMP1~AMPN operate differently from a normal amplifier. The first through N-th amplifiers AMP1~AMPN are disconnected from first through N-th input nodes IN1~INN. In this case, the first through N-th amplifiers AMP1~AMPN feed back voltages of first through N-th output nodes Y1~YN.

Figure 4:
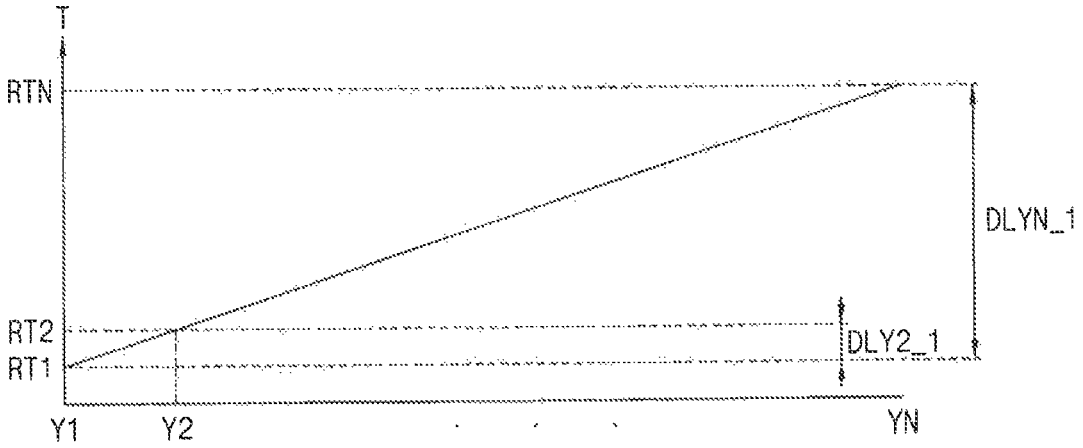
FIG. 4 is a diagram illustrating a timing to start outputting data voltages in the data driver in FIG. 3A, according to an exemplary embodiment of the present inventive concept.
Figure 5:
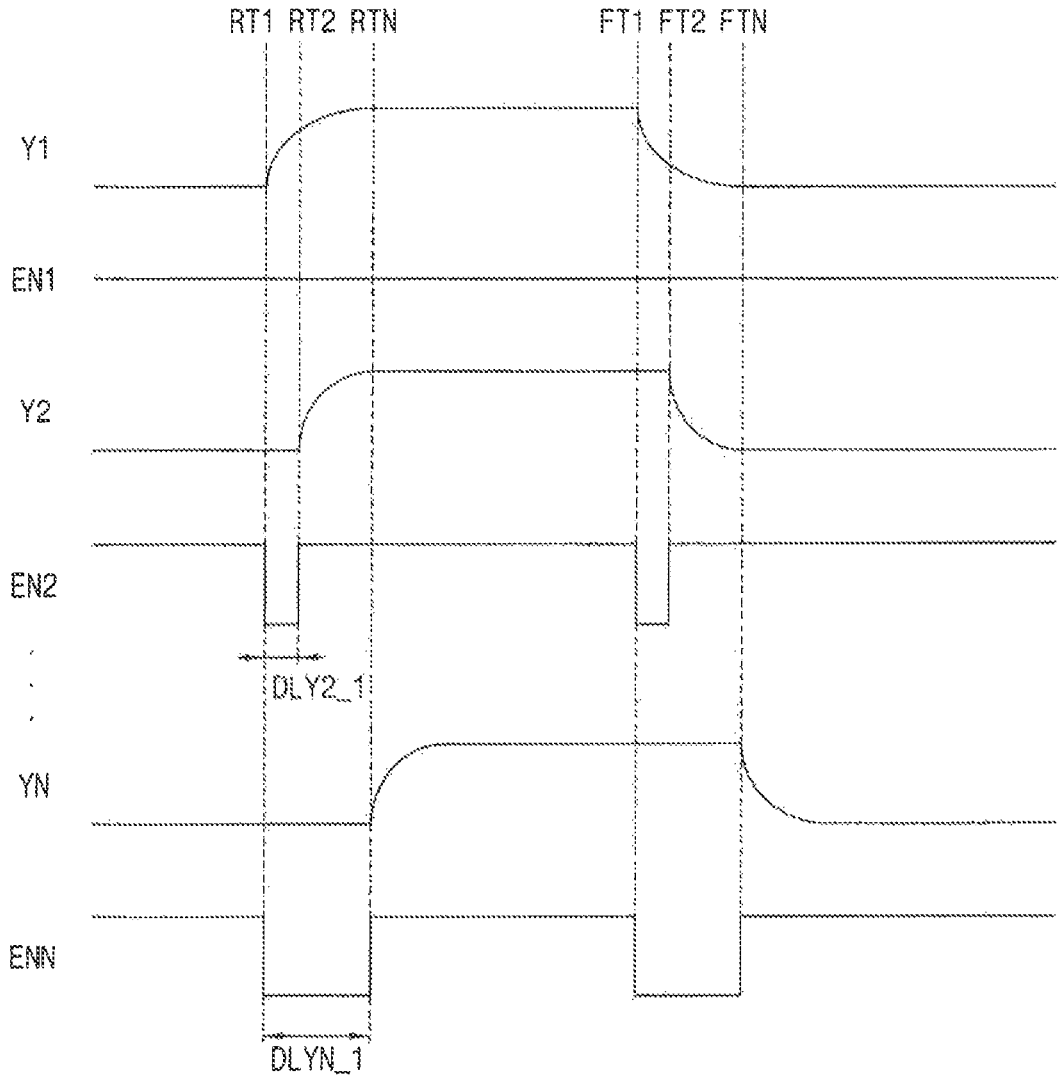
FIG. 5 is a timing diagram illustrating data voltages and enable signals in FIG. 4, according to an exemplary embodiment of the present inventive concept.

FIG. 4 is a diagram illustrating a timing to start outputting data voltages in the data driver in FIG. 3A, according to an exemplary embodiment of the present inventive concept. FIG. 5 is a timing diagram illustrating data voltages and enable signals in FIG. 4, according to an exemplary embodiment of the present inventive concept.

Referring to FIGS. 1, 2, 3A through 3C, 4 and 5, the gate driver 300 may output a first gate signal to the first gate line GL1. While the first gate signal is outputted, data voltages are charged to pixels connected to the first gate line GL1. A duration when the data voltages are charged to the pixels connected to the first gate line GL1 is a first horizontal duration.

The first data driving chip 501 may output the first through N-th data voltages to the first through N-th data lines DL1~DLN through the first through N-th output nodes Y1~YN in the first horizontal duration. The first data driving chip 501 may output the first through N-th data voltages at different times from each other in the first horizontal duration. The first data driving chip 501 may determine times to output the first through N-th data voltages according to a distance between the first through N-th data lines DL1~DLN and the gate driver 300.

For example, the first amplifier AMP1 may start outputting the first data voltage at a first start time RT1 to the first output node Y1 in the first horizontal duration and may stop outputting the first data voltage at a first stop time FT1. The second amplifier AMP2 may start outputting the second data voltage at a second start time RT2 to the second output node Y2 in the first horizontal duration and may stop outputting the second data voltage at a second stop time FT2. The second start time RT2 may be later than the first start time RT1 by a first delay DLY2_1. The second stop time FT2 may be later than the first stop time FT1 by the first delay DLY2_1. The N-th amplifier AMPN may start outputting the N-th data voltage at an N-th start time RTN to the N-th output node YN in the first horizontal duration and may stop outputting the N-th data voltage at an N-th stop time FTN. The N-th start time RTN may be later than the first start time RT1 by a second delay DLYN_1. The N-th stop time FTN may be later than the first stop time FT1 by the second delay DLYN_1. In this case, the first data line DL1 may be the most adjacent data line to the gate driver 300.

The first enable signal EN1 may have a high level during the first horizontal duration. The first switch SW1_1 of the first amplifier AMP1 may be closed during the first horizontal duration, and the second switch SW2_1 of the first amplifier AMP1 may be open during the first horizontal duration.

The second enable signal EN2 may have the low level at the first start time RT1 and the first stop time FT1 in the first horizontal duration.

The N-th enable signal ENN may have the low level at the first and second start times RT1, RT2 and the first and second stop times FT1, FT2 in the first horizontal duration.

Figure 6:
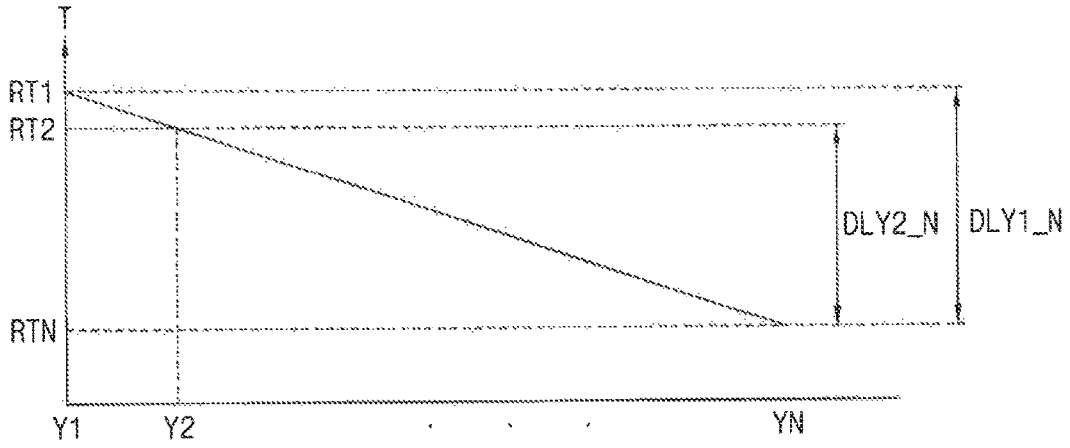
FIG. 6 is a diagram illustrating a timing to start outputting data voltages in the data driver in FIG. 3A, according to an exemplary embodiment of the present inventive concept.
Figure 7:
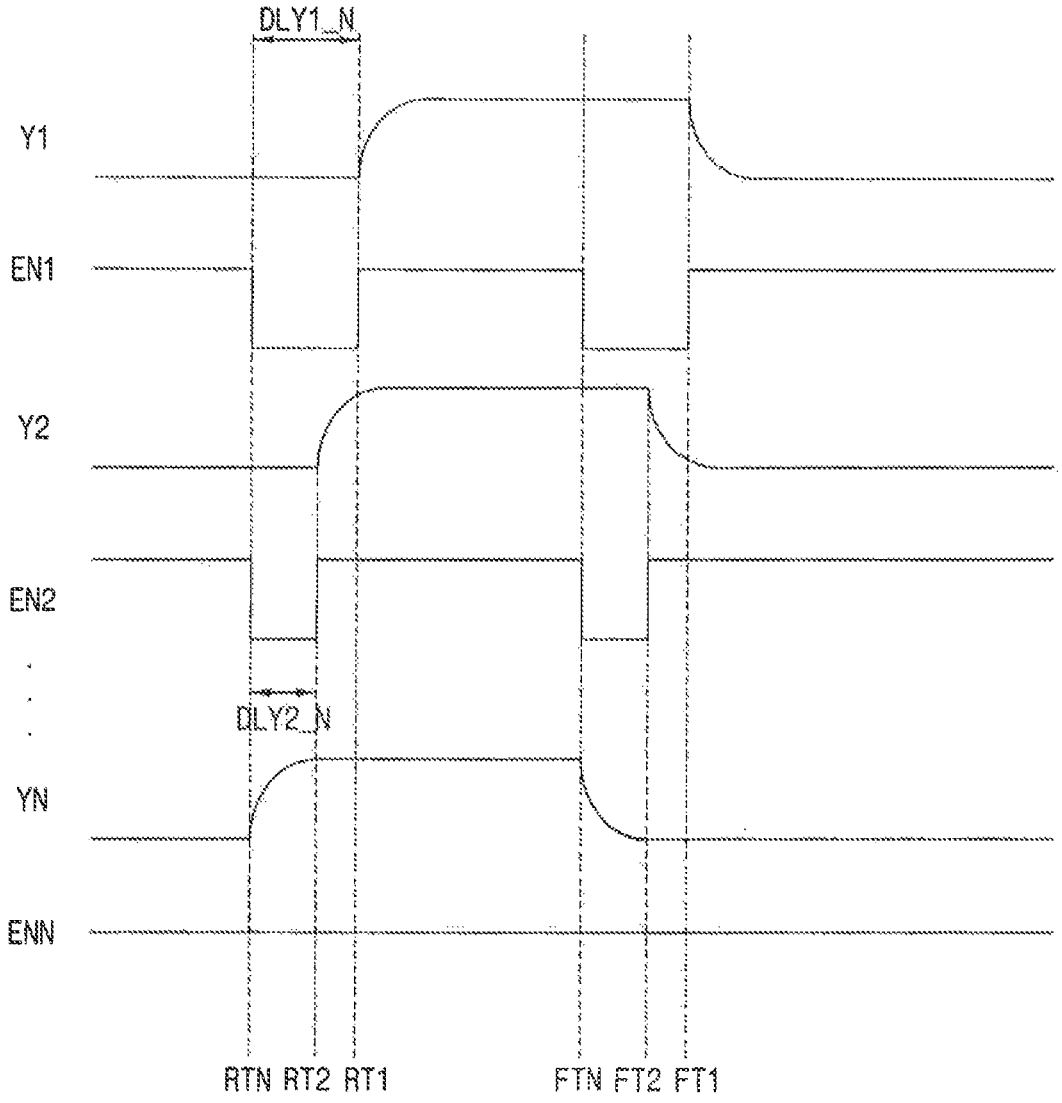
FIG. 7 is a timing diagram illustrating data voltages and enable signals in FIG. 6, according to an exemplary embodiment of the present inventive concept.

FIG. 6 is a diagram illustrating a timing to start outputting data voltages in the data driver in FIG. 3A, according to an exemplary embodiment of the present inventive concept. FIG. 7 is a timing diagram illustrating data voltages and enable signals in FIG. 6, according to an exemplary embodiment of the present inventive concept.

Referring to FIGS. 1, 2, 3A through 3C, 6 and 7, the gate driver 300 may output a first gate signal to the first gate line GL1. While the first gate signal is outputted, data voltages are charged to pixels connected to the first gate line GL1. A duration when the data voltages are charged to the pixels connected to the first gate line GL1 is a first horizontal duration.

The first data driving chip 501 may output the first through N-th data voltages to the first through N-th data lines DL1~DLN through the first through N-th output nodes Y1~YN in the first horizontal duration. The first data driving chip 501 may output the first through N-th data voltages at different times from each other in the first horizontal duration. The first data driving chip 501 may determine times to output the first through N-th data voltages according to a distance between the first through N-th data lines DL1~DLN and the gate driver 300.

For example, the N-th amplifier AMPN may start outputting the N-th data voltage at an N-th start time RTN to the N-th output node YN in the first horizontal duration and may stop outputting the N-th data voltage at an N-th stop time FTN. The second amplifier AMP2 may start outputting the second data voltage at a second start time RT2 to the second output node Y2 in the first horizontal duration and may stop outputting the second data voltage at a second stop time FT2. The second start time RT2 may be later than the N-th start time RTN by a first delay DLY2_N. The second stop time FT2 may be later than the N-th stop time FTN by the first delay DLY2_N. The first amplifier AMP1 may start outputting the first data voltage at a first start time RT1 to the first output node Y1 in the first horizontal duration and may stop outputting the first data voltage at a first stop time FT1. The first start time RT1 may be later than the N-th start time RTN by a second delay DLY1_N. The first stop time FT1 may be later than the N-th stop time FTN by the second delay DLY1_N. In this case, the N-th data line DLN may be the most adjacent data line to the gate driver 300.

The N-th enable signal ENN may have a high level during the first horizontal duration. The first switch SW1_N of the N-th amplifier AMPN may be closed during the first horizontal duration, and the second switch SW2_N of the N-th amplifier AMPN may be open during the first horizontal duration.

The second enable signal EN2 may have the low level at the N-th start time RTN and the N-th stop time FTN in the first horizontal duration.

The first enable signal EN1 may have the low level at the N-th and second start times RTN, RT2 and the N-th and second stop times FTN, FT2 in the first horizontal duration.

According to an exemplary embodiment of the present inventive concept, if a data voltage output timing of each channel is different in a data driver, while data voltages are outputted from channels that have an early output timing, an input from a decoder is blocked in the rest of the channels by using a switch so that a distortion caused by other channels can be reduced. Thus, display quality of the display panel can be increased.

The above described exemplary embodiments may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A data driver, comprising:

an N-th amplifier comprising first and second input nodes and a first output node and configured to output an N-th data voltage to an N-th data line, the first input node receiving the N-th data voltage from an N-th node, the second input node being connected to the first output node;

a first switch connected between the N-th node and the first input node; and a second switch connected between the first input node and the second input node, wherein N is a positive integer equal to or greater than 2, wherein the N-th node is connected to the first input node when the first switch is closed, and wherein the N-th node is not connected to both the first input node and the second input node when the first switch is open, wherein the data driver further comprises:

an (N−1)-th amplifier configured to output an (N−1)-th data voltage to an (N−1)-th data line, wherein the (N−1)-th amplifier is configured to start outputting the (N−1)-th data voltage at a first time during a first horizontal duration, and the N-th amplifier is configured to start outputting the N-th data voltage at a second time during the first horizontal duration, the second time being later than the first time, and wherein the first switch is open at the first time, and the second switch is closed at the first time.

2. The data driver of claim 1, wherein the first switch is closed at the second time, and the second switch is open at the second time.

3. The data driver of claim 1, wherein the (N−1)-th amplifier is configured to stop outputting the (N−1)-th data voltage at a third time, and the N-th amplifier is configured to stop outputting the N-th data voltage at a fourth time later than the third time, and wherein the first switch is open at the third time, and the second switch is closed at the third time.

4. The data driver of claim 3, wherein the first switch is closed at the fourth time, and the second switch is open at the fourth time.

5. The data driver of claim 1, further comprising:

an (N+1)-th amplifier comprising third and fourth input nodes and a second output node and configured to start outputting an (N+1)-th data voltage to an (N+1)-th data line at a third time during the first horizontal duration, the third input node receiving the (N+1)-th data voltage from an (N+1)-th node, the fourth input node being connected to the second output node, the third time being later than the second time;

a third switch connected between the (N+1)-th node and the third input node and open at the first and second times; and a fourth switch connected between the third input node and the fourth input node and closed at the first and second times.

6. The data driver of claim 5, wherein the third switch is closed at the third time, and the fourth switch is open at the third time.

7. The data driver of claim 1, wherein the first and second switches are configured to be controlled by an N-th enable signal and are configured to operate in an opposite way from each other in response to the N-th enable signal.

8. A display apparatus, comprising:

a display panel comprising a plurality of gate lines and an N-th data line and configured to display an image;

a gate driver configured to output gate signals to the gate lines; and a data driver comprising:

an N-th amplifier comprising first and second input nodes and a first output node and configured to output an N-th data voltage to the N-th data line, the first input node receiving the N-th data voltage from an N-th node, the second input node being connected to the first output node;

a first switch connected between the N-th node and the first input node; and a second switch connected between the first input node and the second input node, wherein N is a positive integer equal to or greater than 2, wherein the N-th node is connected to the first input node when the first switch is closed, and wherein the N-th node is not connected to both the first input node and the second input node when the first switch is opened, wherein the display panel further comprises an (N−1)-th data line, wherein the data driver further comprises an (N−1)-th amplifier configured to output an (N−1)-th data voltage to the (N−1)-th data line, wherein the (N−1)-th amplifier is configured to start outputting the (N−1)-th data voltage at a first time during a first horizontal duration, and the N-th amplifier is configured to start outputting the N-th data voltage at a second time during the first horizontal duration, the second time being later than the first time, and wherein the first switch is open at the first time, and the second switch is closed at the first time.

9. The display apparatus of claim 8, wherein the N-th data line is spaced farther apart from the gate driver than the (N−1)-th data line.

10. The display apparatus of claim 8, wherein the first switch is closed at the second time, and the second switch is open at the second time.

11. The display apparatus of claim 8, wherein the (N−1)-th amplifier is configured to stop outputting the (N−1)-th data voltage at a third time, and the N-th amplifier is configured to stop outputting the N-th data voltage at a fourth time later than the third time, and wherein the first switch is open at the third time, and the second switch is closed at the third time.

12. The display apparatus of claim 11, wherein the first switch is closed at the fourth time, and the second switch is open at the fourth time.

13. The display apparatus of claim 8, wherein the display panel further comprises an (N+1)-th data line, and wherein the data driver further comprises:

an (N+1)-th amplifier comprising third and fourth input nodes and a second output node and configured to start outputting an (N+1)-th data voltage to the (N+1)-th data line at a third time during the first horizontal duration, the third input node receiving the (N+1)-th data voltage from an (N+1)-th node, the fourth input node being connected to the second output node, the third time being later than the second time;

a third switch connected between the (N+1)-th node and the third input node and open at the first and second times; and a fourth switch connected between the third input node and the fourth input node and closed at the first and second times.

14. The display apparatus of claim 13, wherein the (N+1)-th data line is spaced farther apart from the gate driver than the (N−1)-th and N-th data lines.

15. The display apparatus of claim 13, wherein the third switch is closed at the third time, and the fourth switch is open at the third time.

16. The display apparatus of claim 8, wherein the data driver is configured to generate an N-th enable signal based on the first and second times, and wherein the first and second switches are configured to be controlled by the N-th enable signal and are configured to operate in an opposite way from each other in response to the N-th enable signal.

17. The display apparatus of claim 16, wherein the first switch is closed when the N-th enable signal has a high level and is open when the N-th enable signal has a low level, and wherein the N-th enable signal has the low level at the first time and has the high level at the second time.

18. A data driver, comprising:

a first amplifier including an inverting input node, a non-inverting input node and an output node;

a first switch connected between the non-inverting input node and a first input node through which a first data voltage is provided; and a second switch connected between the inverting input node, and the non-inverting input node, the second switch further connected to the output node, wherein the first and second switches are operated in response to an enable signal, wherein the enable signal is provided directly to each of the first and second switches, wherein the first input node is connected to the non-inverting input node when the first switch is closed, and wherein the first input node is not connected to both the inverting input node and the non-inverting input node when the first switch is open and, when the first switch is open and the second switch is closed, the second switch is directly connected to the inverting input node, the non-inverting input node and the output node, the data driver further comprising a second amplifier, wherein the first amplifier starts outputting the first data voltage at a first time during a first horizontal duration, and the second amplifier starts outputting a second data voltage at a second time during the first horizontal duration, the second time being later than the first time, and wherein the first switch is open at the first time, and the second switch is closed at the first time.

19. The data driver of claim 18, wherein the first amplifier is configured to stop outputting the first data voltage at a third time, and the second amplifier is configured to stop outputting the second data voltage at a fourth time later than the third time.

* * * * *